US011292113B2

(12) United States Patent
Alabi

(10) Patent No.: US 11,292,113 B2
(45) Date of Patent: Apr. 5, 2022

(54) TOOL SYSTEM FOR INSTALLATION/REMOVAL OF INTERFERENCE FIT COMPONENTS

(71) Applicant: Raytheon Technologies Corporation, Farmington, CT (US)

(72) Inventor: Oluwaseun B. Alabi, South Windsor, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 17/358,636

(22) Filed: Jun. 25, 2021

(65) Prior Publication Data

US 2021/0323128 A1 Oct. 21, 2021

Related U.S. Application Data

(62) Division of application No. 16/502,432, filed on Jul. 3, 2019, now Pat. No. 11,077,541.

(51) Int. Cl.
*B25B 27/02* (2006.01)

(52) U.S. Cl.
CPC ..... *B25B 27/023* (2013.01); *B25B 27/026* (2013.01); *F05D 2230/60* (2013.01); *F05D 2230/64* (2013.01); *F05D 2260/37* (2013.01)

(58) Field of Classification Search
CPC . B25B 27/023; B25B 27/026; F05D 2230/60; F05D 2230/64; F05D 2260/37; Y10T 29/4994; F16B 13/0858; F16L 55/1108
See application file for complete search history.

(56) References Cited

U.S. PATENT DOCUMENTS

| | | | |
|---|---|---|---|
| 6,851,167 | B2 | 2/2005 | Harlow et al. |
| 6,892,431 | B2 | 5/2005 | Campbell et al. |
| 7,043,808 | B2 | 5/2006 | Patton |
| 10,040,182 | B2 * | 8/2018 | Kirilichin ..... F16B 13/0858 |

* cited by examiner

*Primary Examiner* — Lee A Holly
(74) *Attorney, Agent, or Firm* — Bachman & LaPointe, P.C.

(57) ABSTRACT

A tool system to install an interference fit component within a bore of a component, includes a guide bushing that at least partially fits within a bore of a component. A drive screw is of a length to extend through the guide bushing and the bore. A threaded insert is receivable at least partially within the bore, the threaded insert receivable at least partially within the interference fit component.

9 Claims, 8 Drawing Sheets

TOOL SYSTEM FOR INSTALLATION/REMOVAL OF INTERFERENCE FIT COMPONENTS

CROSS-REFERENCE TO RELATED APPLICATION

This application is a divisional of U.S. patent application Ser. No. 16/502,432, filed Jul. 3, 2019.

U.S. GOVERNMENT RIGHTS

This invention was made with Government support awarded by the United States. The Government has certain rights in this invention.

BACKGROUND

The present disclosure relates to service tools, and more particularly to a service tool to remove and install interference fit components without damaging the supporting structure therefor.

An engine case for a gas turbine engine typically includes threaded inserts, bushings, and other such components that are mounted therein via an interference fit. An example diffuser case has over one hundred threaded inserts that require replacement during engine overhaul due to predicted wear. Nickel alloy interference fit inserts may be installed with a maximum interference fit of 0.0033 inches (0.08 mm) which requires a significant installation force. For such repairs, a mechanical installation tool is typically utilized. Although effective, conventional mechanical installation tools may have ergonomic, wear, and high repair time concerns.

SUMMARY

A tool system to install an interference fit component within a bore of a component, according to one disclosed non-limiting embodiment of the present disclosure includes a guide bushing that at least partially fits within a bore of a component; a drive screw of a length to extend through the guide bushing and the bore; and a threaded insert that is receivable at least partially within the bore, the threaded insert receivable at least partially within the interference fit component.

A further embodiment of any of the foregoing embodiments of the present disclosure includes a drive to rotate the drive screw.

A further embodiment of any of the foregoing embodiments of the present disclosure includes a hydro-pneumatic pistol grip drive to rotate the drive screw.

A further embodiment of any of the foregoing embodiments of the present disclosure includes an installation mandrel to retain the threaded insert.

A further embodiment of any of the foregoing embodiments of the present disclosure includes that the installation mandrel is hand held.

A further embodiment of any of the foregoing embodiments of the present disclosure includes that the guide bushing comprises a lip that is receivable into the bore.

A further embodiment of any of the foregoing embodiments of the present disclosure includes that the threaded insert comprises a flange to support the interference fit component.

A further embodiment of any of the foregoing embodiments of the present disclosure includes that the flange is of a diameter greater than a diameter of the bore to stop against the component.

A further embodiment of any of the foregoing embodiments of the present disclosure includes that the flange is of a diameter less than a diameter of the bore to drive the threaded insert out of the bore.

A method for installing an interference fit component within a bore of a component, according to one disclosed non-limiting embodiment of the present disclosure includes locating an interference fit component at least partially onto a threaded insert; locating a drive screw though a bore of the component, the drive screw defines an axis of rotation; threading the drive screw into the threaded insert; and rotating the drive screw about the axis of rotation, rotation of the drive screw pulling the threaded insert and the interference fit component into the bore.

A further embodiment of any of the foregoing embodiments of the present disclosure includes that locating the interference fit component at least partially onto the threaded insert comprises abutting the interference fit component onto the threaded insert to abut a flange of the threaded insert.

A further embodiment of any of the foregoing embodiments of the present disclosure includes that the flange is of a diameter greater than a diameter of the bore to stop against the component.

A further embodiment of any of the foregoing embodiments of the present disclosure includes that the flange is of a diameter less than a diameter of the bore to drive the threaded insert out of the bore.

A further embodiment of any of the foregoing embodiments of the present disclosure includes locating the interference fit component and the threaded insert within an installation mandrel.

A further embodiment of any of the foregoing embodiments of the present disclosure includes, further comprising holding the installation mandrel while rotating the drive screw.

A further embodiment of any of the foregoing embodiments of the present disclosure includes that rotating the drive screw comprises hydro-pneumatically rotating the drive screw.

A further embodiment of any of the foregoing embodiments of the present disclosure includes guiding the drive screw with a guide bushing that is at least partially receivable into the bore.

A further embodiment of any of the foregoing embodiments of the present disclosure includes that the step of locating the interference fit component at least partially onto a threaded insert further comprises locating the interference fit component on the threaded insert at one side of the component, and wherein the threading step comprises threading the drive screw into the threaded insert from the other side of the component.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
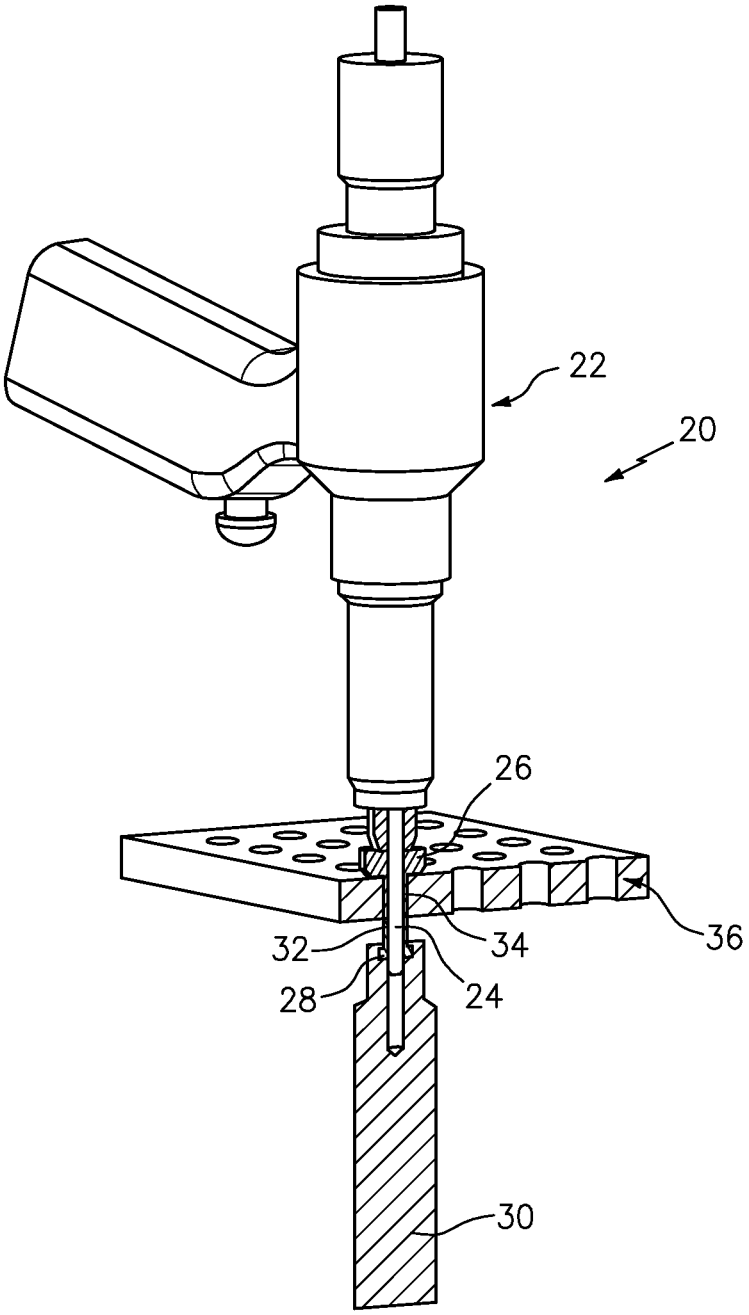
FIG. 1 is a schematic cross-sectional view of a tool system to remove and install interference fit components without damaging the supporting structure.

FIG. 1 schematically illustrates a tool system 20. The tool system 20 facilitates the installation of threaded inserts, bushings, and other such interference fit components into a case of a gas turbine engine with reduced repair time, minimum immediate wear and no ergonomic concerns. In one example, the tool system 20 reduces the installation time to install 120 threaded inserts into a diffuser case of a gas turbine engine from 600 minutes to approximately 30 minutes.

The tool system 20 generally includes a hydro-pneumatic pistol grip drive 22, a drive screw 24 driven thereby, a guide bushing 26, a threaded insert 28 and an installation mandrel 30 which locate an interference fit component 32 such as a threaded insert or bushing within a bore 34 of a component 36. The component 36 as utilized herein may be an engine case of a gas turbine engine (FIG. 2) or any structure, wall, or other aspect of the engine case or component, typically having one or more bores into which other pieces such as bushings, bearings, etc., are mounted. The pistol grip drive 22 may be exemplified by a hydro-pneumatic 07267 tool manufactured by Avdel® of Letchworth Garden City, UK. The pistol grip drive 22 is operable to rotate the drive screw 24 about an axis of rotation A and provide over 8000 pounds of force.

Figure 2:
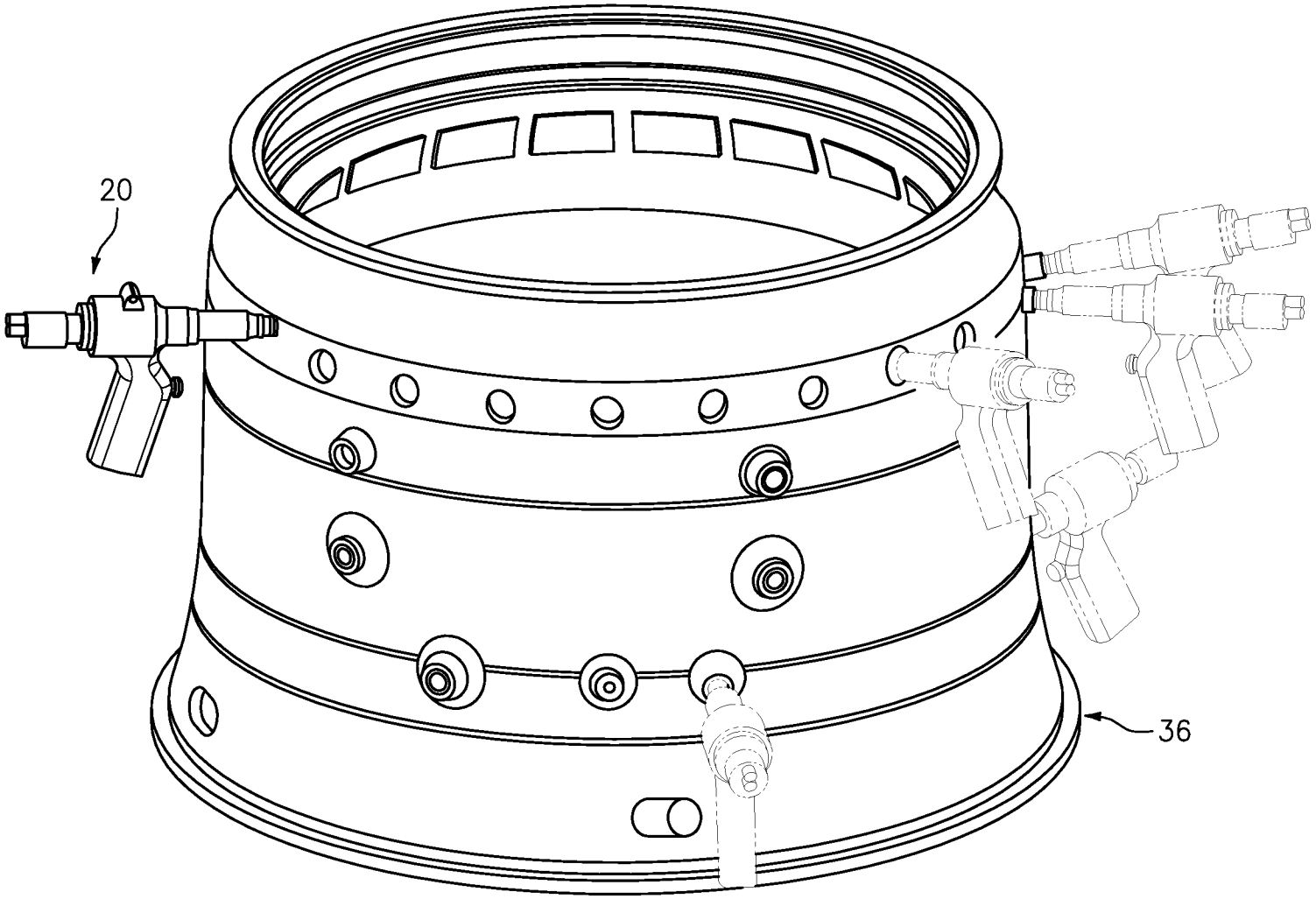
FIG. 2 is an example usage of the tool system on a diffuser case of a gas turbine engine.
Figure 3:
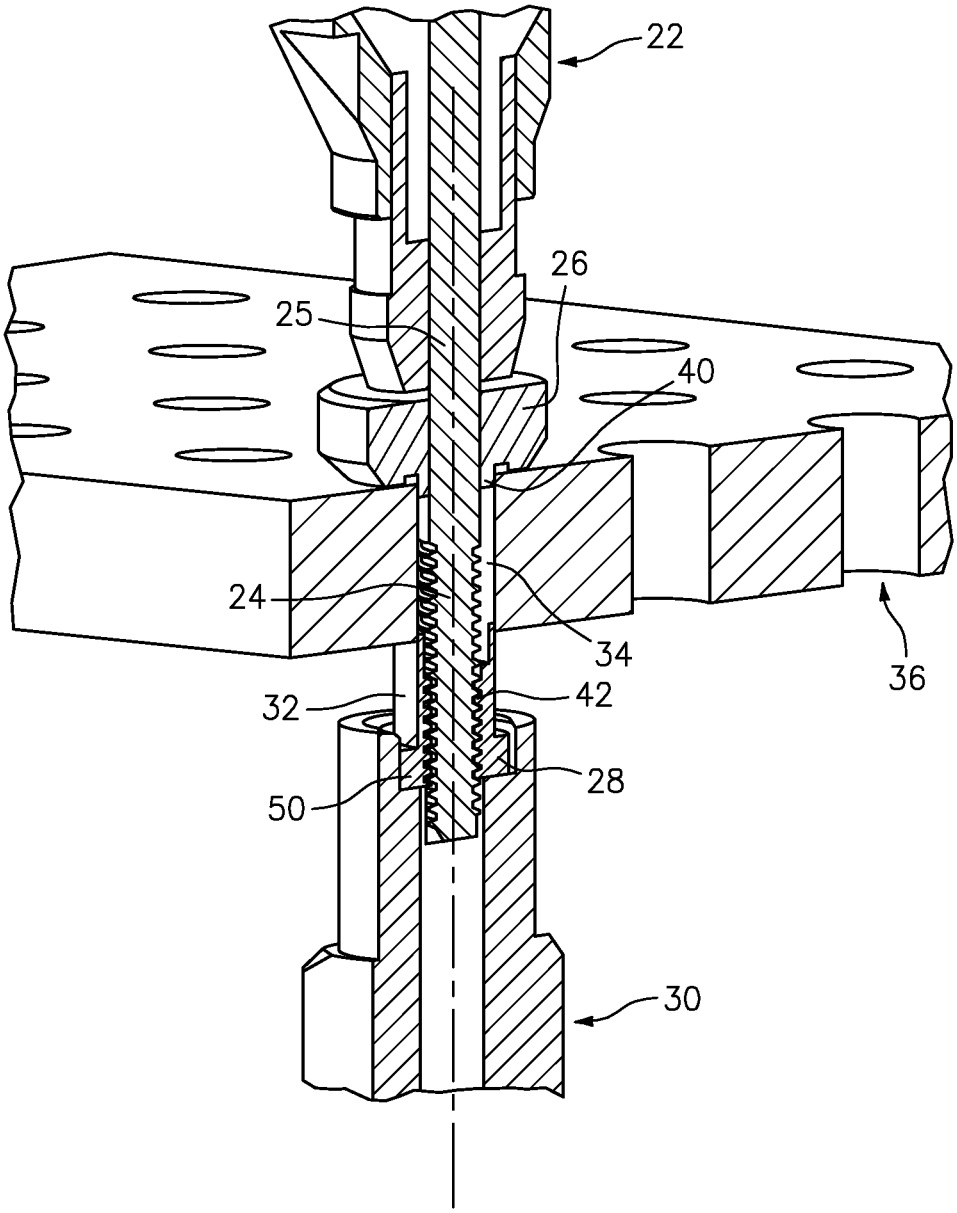
FIG. 3 is a schematic cross-sectional view of the tool system.

With reference to FIG. 3, the guide bushing 26 at least partially fits within the bore 34 of the component 36. The guide bushing 26 may include a lip 40 that fits into the bore 34 to position the drive screw 24. The guide bushing 26 is located on the pistol grip drive 22 side of the component 36 to protect the component 36 from the pistol grip drive 22. That is, the pistol grip drive 22 is located opposite the installation side of the component 36 (FIG. 2).

The drive screw 24 is of a length to extend through the guide bushing 26 and the bore 34. A pilot diameter 25 on the drive screw 24 slip fits within the guide bushing 26 to facilitate alignment. The drive screw 24 threads into an internal thread 42 of the threaded insert 28 (also shown in FIG. 4).

Figure 4:
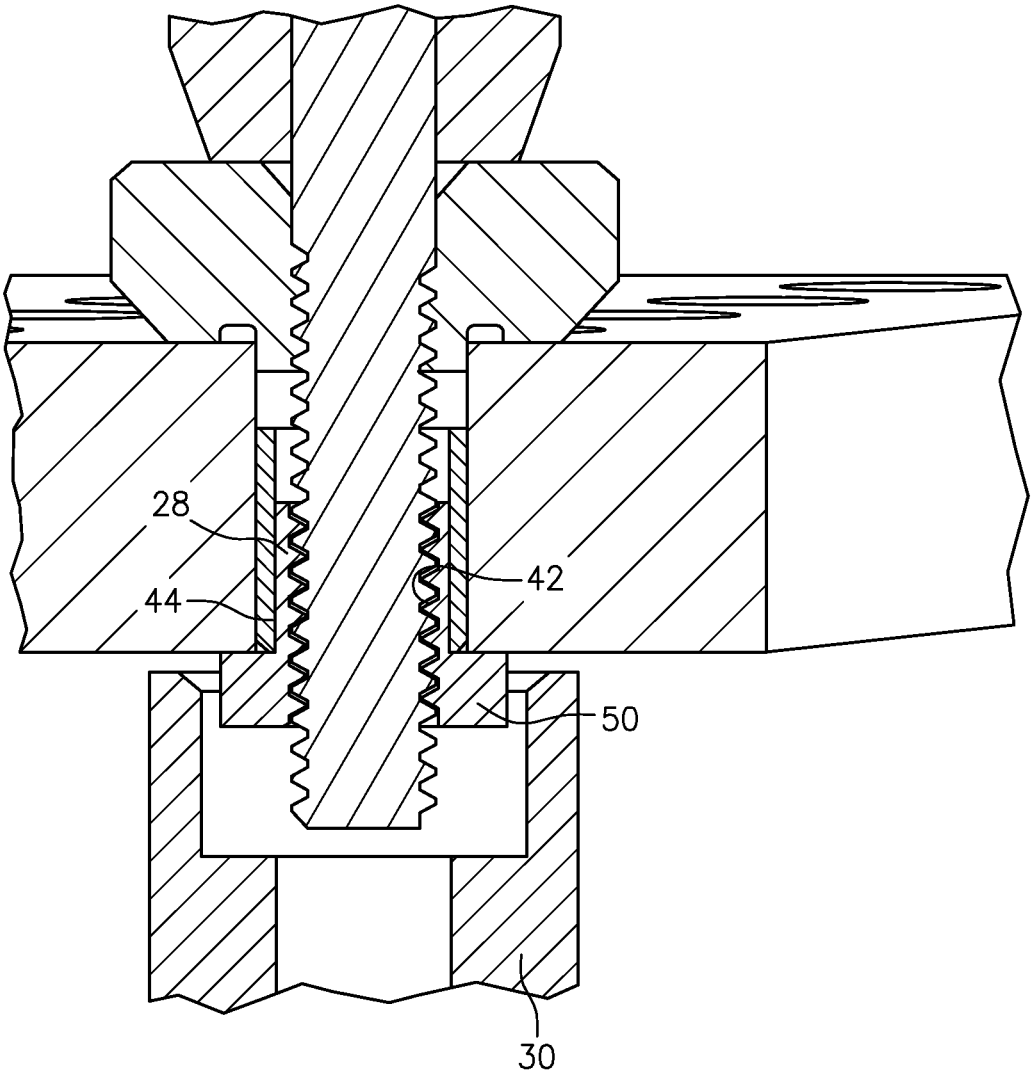
FIG. 4 is an expanded schematic cross-sectional view of the tool system.
Figure 5:
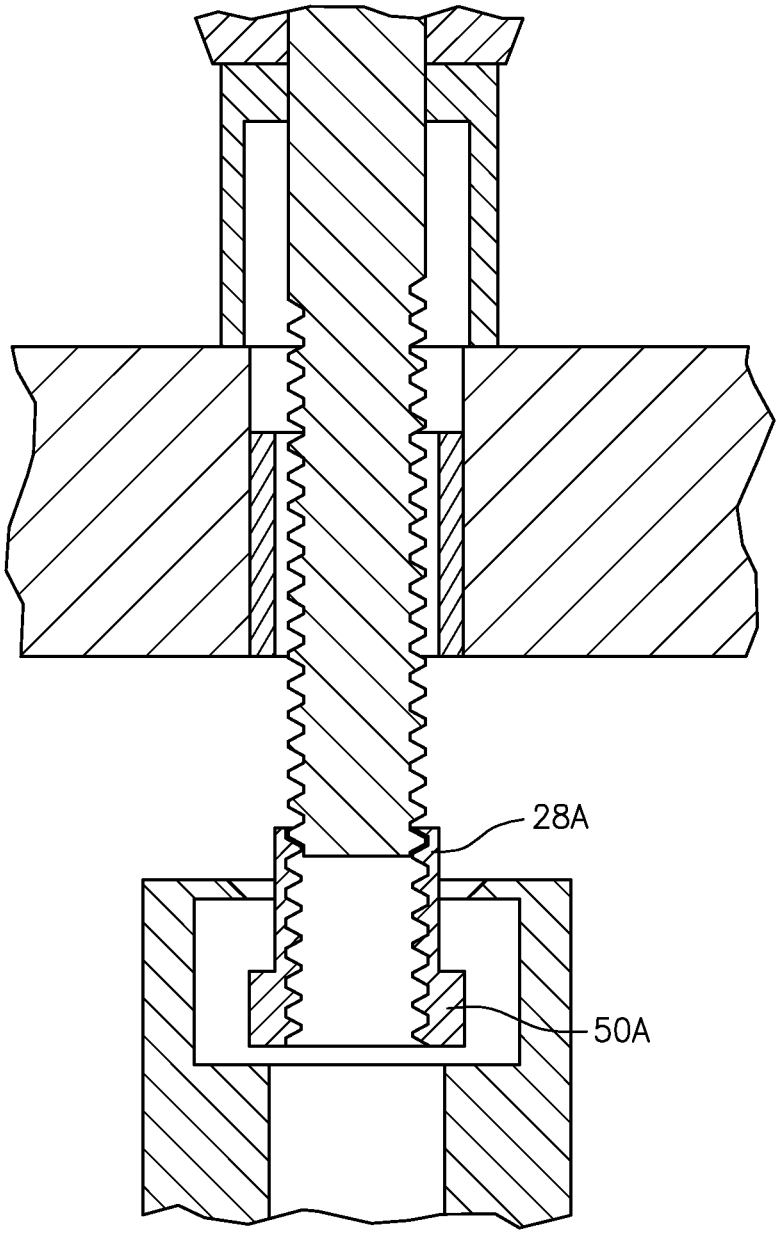
FIG. 5 is an expanded schematic cross-sectional view of the tool system with a threaded insert for removal of an interference fit component.
Figure 6:
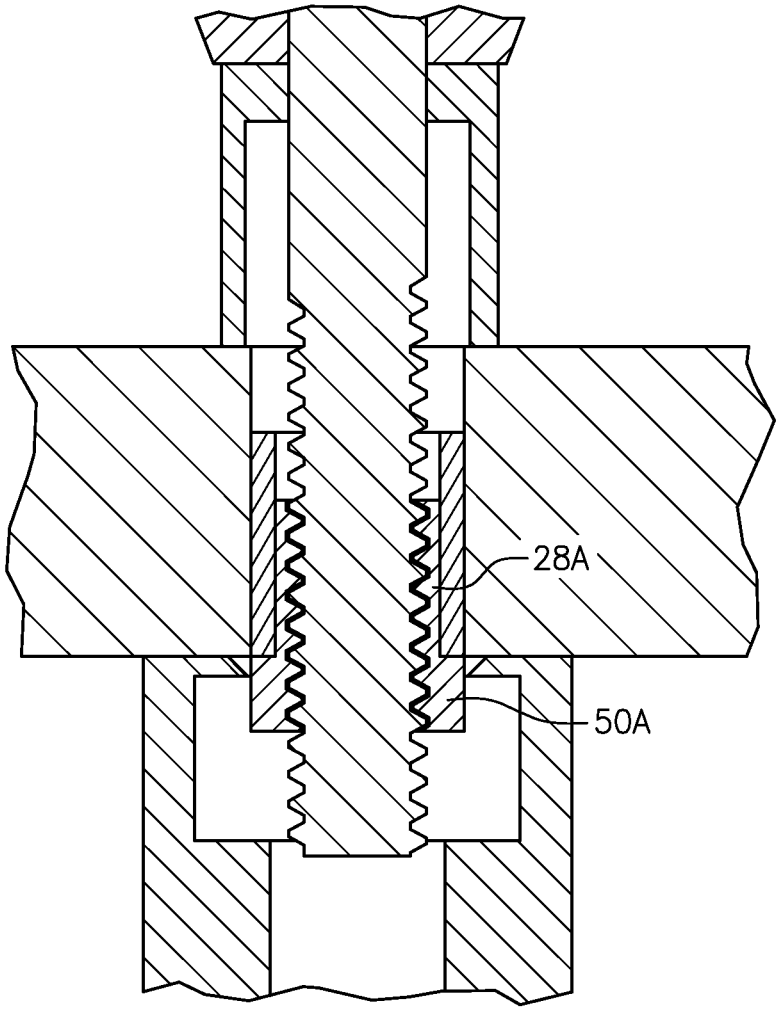
FIG. 6 is an expanded schematic cross-sectional view of the tool system with the threaded insert of FIG. 5 in a first position.
Figure 7:
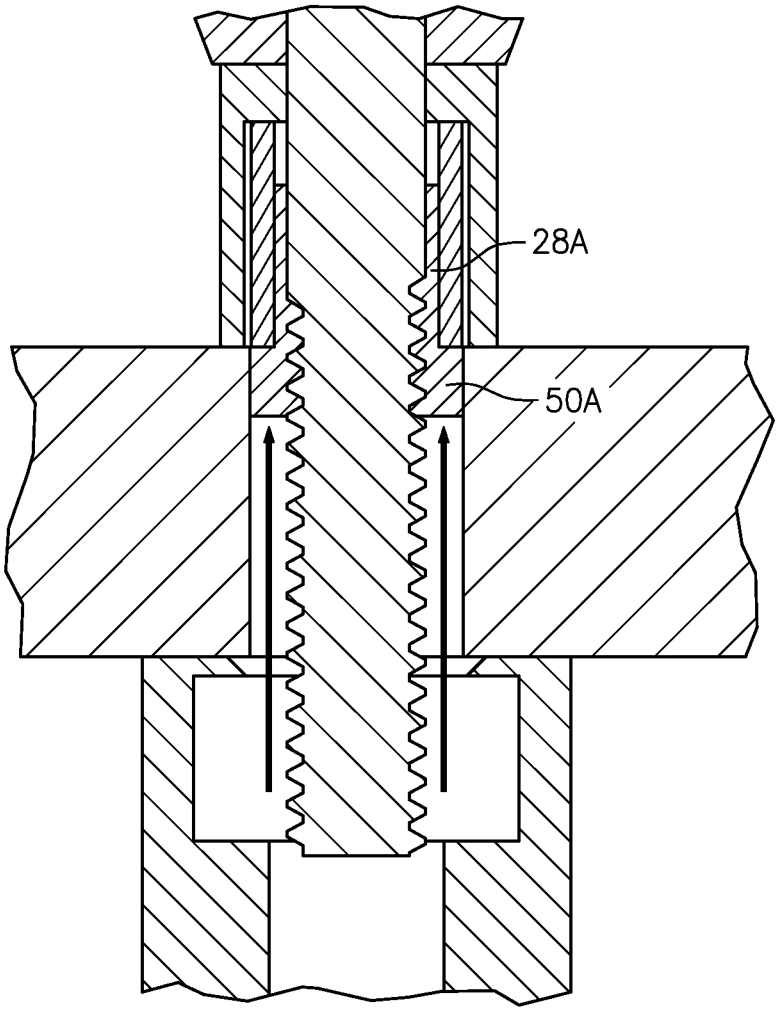
FIG. 7 is an expanded schematic cross-sectional view of the tool system with the threaded insert of FIG. 5 in a second position with the interference fit component removed from the component.

With reference to FIG. 4, the threaded insert 28 provides a smooth outer surface 44 over which the interference fit component 32 is received. The threaded insert 28 includes a flange 50 that supports the threaded insert 28. The threaded insert 28 is receivable at least partially within the interference fit component 32 such that the threaded insert 28 can be driven at least partially within the interference fit component 32 as the threaded insert 28 is driven along the drive screw 24. The flange 50 may be of a diameter greater than a diameter of the bore 34 to stop against the component 36 upon full installation of the interference fit component 32. Alternatively, a threaded insert 28A may include a flange 50A (FIGS. 5, 6 and 7) of a diameter less than a diameter of the bore 34 to facilitate removal of the interference fit component 32 from the bore 34 by pulling completely though the component 36.

The installation mandrel 30 retains the threaded insert 28 which supports the interference fit component 32. The installation mandrel 30 may be a hand-held cylindrical member that is manually held by a user on an opposite side of the component 36 to position the interference fit component 32. That is, the installation mandrel 30 essentially presents the interference fit component 32 for receipt of the drive screw 24.

Figure 8:
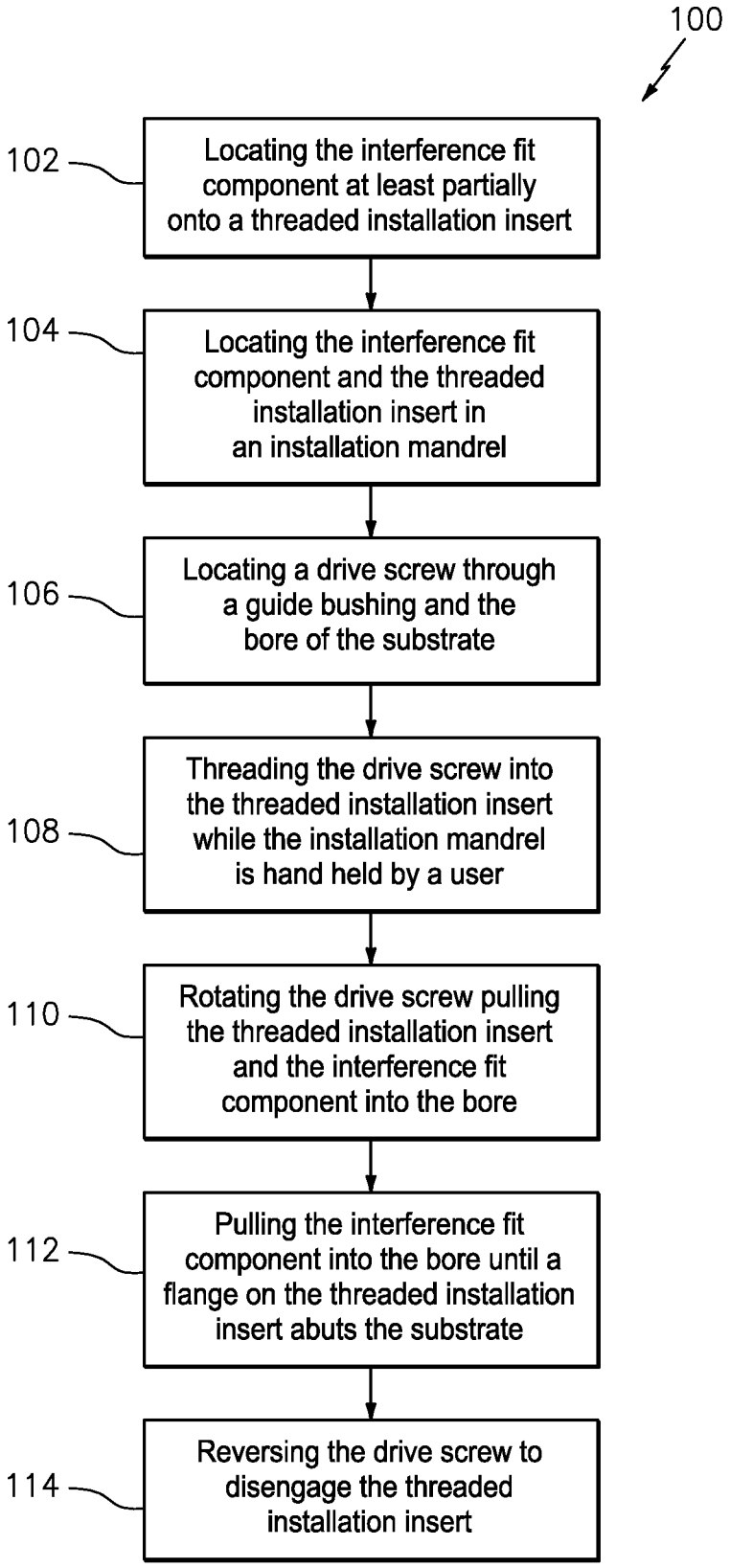
FIG. 8 is a flow chart illustrating a method of operation of the tool system for installing an interference fit component within a bore of the component.

With reference to FIG. 8, a method 100 for installing the interference fit component 32 within the bore 34 of the component 36 initially includes locating the interference fit component 32 at least partially onto the threaded insert 28 (102). The interference fit component 32 and the threaded insert 28 may then be located in the installation mandrel 30 (104). Next, the drive screw 24 of the pistol grip drive 22 is located through the guide bushing 26 and the bore 34 of the component 36 (106). The drive screw 24 is then threaded into the threaded insert 28 while the installation mandrel 30 is hand held by a user (108). The user then actuates the pistol grip drive 22 rotating the drive screw 24 about the axis of rotation such that the drive screw 24 pulls the threaded insert 28 and the interference fit component 32 into the bore 34 (110). The drive screw 24 pulls the threaded insert 28 and the interference fit component 32 into the bore 34 until the flange 50 on the threaded insert 28 abuts the component 36 (112). The drive screw 24 may then be reversed to disengage the threaded insert 28 from the drive screw 24 (114).

To remove the interference fit component 32 with the tool system 20, the threaded insert 28A with the flange 50A that is of a diameter less than a diameter of the bore 34, is threaded to the drive screw 24 with the drive screw 24 passing through the interference fit component 32. The pistol grip drive 22 is then used to rotate the drive screw 24 to pull the interference fit component 32 out through the bore 34 in the direction of the pistol grip drive 22.

The system 20 not only provides the required process parameters to effectively reliably and repeatably install the interference fit components, it is portable and adaptable to different interference fit components. The system 20 also addresses the ergonomic concerns regarding high tolerance and high force required for installation and removal of the interference fit components.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed is:

1. A tool system to install an interference fit component within a bore of a component, comprising:

a guide bushing that at least partially fits within a bore of a component;

a drive screw of a length to extend through the guide bushing and the bore; and a threaded insert that is receivable at least partially within the bore, the threaded insert receivable at least partially within the interference fit component.

2. The system as recited in claim 1, further comprising an installation mandrel to retain the threaded insert.

3. The system as recited in claim 2, wherein the installation mandrel is hand held.

4. The system as recited in claim 1, wherein the threaded insert comprises a flange to support the interference fit component.

5. The system as recited in claim 4, wherein the flange is of a diameter greater than a diameter of the bore to stop against the component.

6. The system as recited in claim 4, wherein the flange is of a diameter less than a diameter of the bore to drive the threaded insert out of the bore.

7. The system as recited in claim 1, further comprising a drive to rotate the drive screw.

8. The system as recited in claim 1, further comprising a hydro-pneumatic pistol grip drive to rotate the drive screw.

9. The system as recited in claim 1, wherein the guide bushing comprises a lip that is receivable into the bore.

* * * * *